United States Patent [19]

Shiozaki et al.

[11] 4,108,694

[45] Aug. 22, 1978

[54] CONTINUOUSLY CAST SLABS FOR PRODUCING GRAIN-ORIENTED ELECTRICAL STEEL SHEETS HAVING EXCELLENT MAGNETIC PROPERTIES

[75] Inventors: Morio Shiozaki; Yozo Suga; Hiromu Fujii; Kohichi Fujiwara, all of Himeji, Japan

[73] Assignee: Nippon Steel Corporation, Tokyo, Japan

[21] Appl. No.: 823,451

[22] Filed: Aug. 10, 1977

[30] Foreign Application Priority Data

Aug. 10, 1976 [JP] Japan ..... 51-94468

[51] Int. Cl.[2] ..... B22D 27/02; B22D 11/04; H01F 1/04; H01F 1/14

[52] U.S. Cl. ..... 148/31.55; 148/110; 148/111; 148/112; 148/113; 164/49; 164/82

[58] Field of Search ..... 148/31.55, 110, 111, 148/112, 113, 2, 3; 75/123 L; 164/49, 82

[56] References Cited

U.S. PATENT DOCUMENTS

| | | | |
|---|---|---|---|
| 2,877,525 | 3/1959 | Schaaber | 164/49 |
| 2,963,758 | 12/1960 | Pestel et al. | 164/49 |
| 3,089,795 | 5/1963 | Hu | 148/31.55 |
| 4,014,717 | 3/1977 | Barisoni et al. | 148/31.55 |

*Primary Examiner*—W. Stallard

*Attorney, Agent, or Firm*—Wenderoth, Lind & Ponack

[57] ABSTRACT

A continuously cast steel slab for production of a grain-oriented electrical steel sheet having excellent magnetic properties in which at least 95% of the total number of grains constituting an equi-axed crystal zone in said slab has a cross sectional dimension less than 9 $mm^2$ per one grain.

3 Claims, 7 Drawing Figures

Ordinary Continuously Cast Slab (x1/5)

Ordinary Continuously Cast Slab
during the Heating Step (x1/5)

- Surface 1330°C
- Center 1260°C

Ordinary Continuously Cast Slab
during the Heating Step (x1/5)

- Fully Heated to 1340°C (a) As Cast (b) Fully Heated at 1360°C

Changes caused by Heating a Steel Slab Continuously Cast with Electro-magnetic Stirring (x1/5)

CONTINUOUSLY CAST SLABS FOR PRODUCING GRAIN-ORIENTED ELECTRICAL STEEL SHEETS HAVING EXCELLENT MAGNETIC PROPERTIES

BACKGROUND OF THE INVENTION

1. Field of the Invention:

The present invention relates to continuously cast slabs for production of grain-oriented electrical steel sheets or strips having excellent magnetic properties, particularly grain-oriented electrical steel sheets in which the component grain of body-centered cubic lattice has a grain orientation of (110)[001] by Miller indices.

A high magnetic flux density grain-oriented electrical steel sheet has generally an excellent magnetic flux density value, usually expressed by the $B_{10}$ value, and a method for producing the same is disclosed in U.S. Pat. No. 3,636,579. According to the disclosure of the U.S. Patent, it is suggested that a continuously cast slab may be used as a starting material in the proposed method. However, the U.S. Patent discloses or teaches nothing about the continuous casting method.

In recent years, the industrilization of continuous casting techniques has been progressing rapidly, and the continuous casting techniques themselves have been making remarkable progress. Continuous casting processes have technical advantages such as the possibility of producing slabs of uniform chemical composition, hence uniform properties, along the slab length, in addition to commercial advantages such as improved production yield due to simplification of the production steps, and increased productivity by saving labour.

The utilization of continuous casting processes has been made progressively also in the field of the production of grain-oriented electrical steel sheets and resulted in various advantages, but on the other hand such problems have been often encountered that the secondary recrystallization is not complete in the final product, thus resulting in inferior magnetic properties.

In order to overcome the above defects in producing grain-oriented electrical steel sheets by continuous-casting, various technical solutions have been proposed. For instance, U.S. Pat. No. 3,764,406 discloses a method for producing grain-oriented electrical steel sheets by two-step hot rolling of a continuous cast slab, and Japanese Patent Publication Sho 50- 37009, as well as the corresponding U.S. Pat. No. 3,841,924, proposes a method for producing a high magnetic flux density grain-oriented electrical steel sheet similarly by two-step hot rolling of a continuously cast slab.

It should be noted, however, that both of the prior art relates to production of hot bands by two-step hot rolling, not fully utilizing the technical advantages inherent with the continuous casting process.

Final products produced from continuous cast steel slabs are generally susceptible to the imcomple secondary recrystallization portion, usually called "streaks", as pointed out in U.S. Pat. No. 3,764,406, and "Metallurgical Transaction" Vol. 6-A, May 1975, page 1041, and the cause of this "streaks" is attributed to the fact that the grains grow excessively in the slab due to the slab heating prior to the hot rolling, resulting in large elongated grains in the hot bands.

According to the disclosures of U.S. Pat. No. 3,764,406, Japanese Patent Publication Sho 50-37009, as well as U.S. Pat. No. 3,841,924, it is possible to prevent occurrence of the incomplete secondary recrystallization portion in the final product when the excessive grain growth during the slab reheating prior to the second hot rolling is prevented by preheating of the slab and a preliminary hot rolling (prerolling), so as to maintain an average grain size not larger than 7 mm in diameter according to U.S. Pat. No. 3,764,406, and to maintain at least 80% in the size of an average grain size less than 25 mm in diameter according to Japanese Patent Publication Sho 50-37009 and U.S. Pat. No. 3,841,924.

SUMMARY OF THE INVENTION

Therefore, one of the objects of the present invention is to provide a continuously cast slab having an improved structure, and to provide a grain-oriented electrical steel sheet having excellent magnetic properties by hot rolling the above continuously cast slab in a single step.

Another object of the present invention is to provide uniformly a grain-oriented electrical steel sheet having a magnetic flux density ($B_{10}$) of 1.83 T or higher at a lower production cost.

The present invention will be described in more detail referring to the attached drawings.

DESCRIPTION OF PREFERRED EMBODIMENT

The present inventors have made extensive studies and revealed for the first time stepwise developments of the abnormal grain growth in a continuously cast slab when the cast slab is heated to high temperatures.

Figure 1:
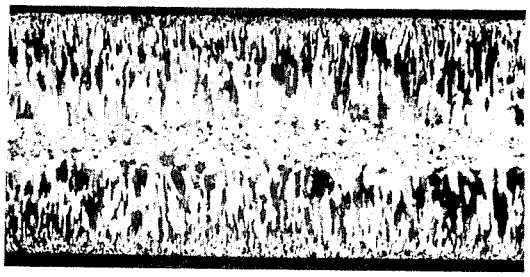
FIG. 1 is a photograph showing a cross sectional structure of a continuously cast slab by a conventional method.

As shown in FIG. 1, the cross sectional structure of a continuously cast slab has usually chilled grains in its surfacial layer, with columnar grains developing from the chilled crystal zone into the inner portion, and with non-uniform equiaxed grains ranging from a fine grain size of 0.5 mm in diameter or smaller to a coarse grain size of about 4 mm in diameter in the final solidification structure around the center portion.

Figure 2:
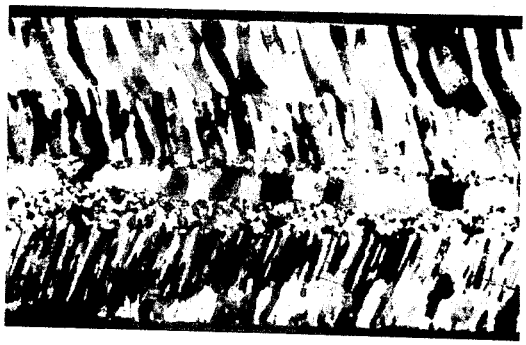
FIG. 2 and FIG. 3 are photographs showing the grain growth in the slab corresponding to the heating steps of the continuously cast slab shown in FIG. 1.
Figure 3:
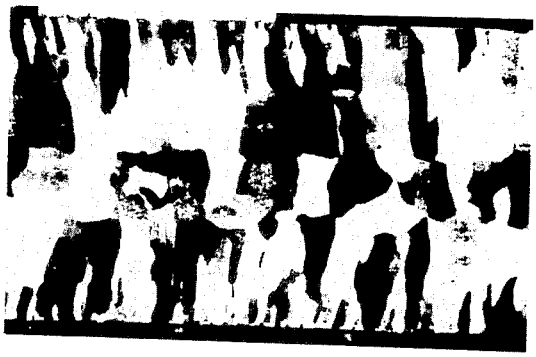

When a continuously cast slab having such a cross sectional structure as above is heated in a range of from 1300° to 1400° C, the chilled grains and the columnar grains begin to grow successively from the surfacial layer, but before the whole of the columnar crystal zone performs the grain growth, part of the equi-axed crystal zone in the slab central portion begins to assume an abnormal grain growth as if it was a secondary grain growth, contrary to an ordinary grain growth, and the grains grow coarse. Then the coarse grains developing from the equi-axed grain zone absorb the columnar grains, which have not yet grown at the heated condition between 1300°C and 1400° C, and grow into still coarser grains, finally into grains of about 70 to 140 mm in diameter which is equal to ½ or ¼ of the slab thickness. The above developments are shown in FIG. 2 and FIG. 3.

Meanwhile, the grains in the columnar crystal zone of the cast structure have already grown to grains of about 15 mm in diameter elongated about 50 mm in the slab thickness direction in the heating stage between 1300° and 1400° C. It is very confusing to define the size of the grains growing from the columnar grain zone simply in an average grain diameter, but it may be said to be about 30 mm or larger.

When the slab in which the grain growth took place in the heating stage between 1300° and 1400° C is hot rolled, and the hot band is used as a starting material to obtain a final product, incomplete secondary recrystallized portions appear in the final product, with remarkable deterioration of the magnetic properties.

It has been revealed from the observation of the structure of the hot band that the occurrence of the incomplete secondary recrystallized portions is attributable to the large elongated grains in the hot band, and that the large elongated grains are caused if the excessively grown grains in the equi-axed crystal zone of the slab are not destroyed during the hot rolling and do not recrystallize into fine grains. It has been also revealed that the coarse grains which have developed from the columnar crystal zone of the slab have almost no influence on the magnetic properties of the final product. This is because the coarse grains which have developed from the columnar crystal zone are present in the surfacial layer of the slab and are divided into fine and uniform grains due to the repeated rolling and recrystallization at a lower temperature than the central portion of the sheet slab during the hot rolling.

The present inventors have studied carefully and in details and unique phenomena mentioned above, and it has been found that it is possible to prevent the development of the coarse grains from the equi-axed crystal zone during the slab heating at a temperature in a range of from 1300° to 1400° C before the single-step hot rolling step by improving the cast structure of a continuously cast slab. Thus, when the equi-axed grains are small and uniform, it never happens that specific grains grow abnormally into coarse grains.

Whereas in case of a continuously cast slab having an ordinary structure, it has been revealed that the equi-axed grains are not uniform in their size, and larger grains absorb smaller ones to easily grow into coarser grains.

Although not theoretically clarified yet, the mechanism of the growth of coarse grains from the equi-axed crystal zone in the slab central portion has been considered as that the distribution of the equi-axed grains and the degree of segregation of various component element, play an important role in the mechanism, because the source for the grain growth exists in the central portion which is at the lowest temperature.

Based on the foregoing technical background, the present inventors have conducted various extensive studies, and it has been found that the objects of the present invention can be achieved by restricting at least 95% in the size of number of the grains constituting the equi-axed crystal zone in a continuously cast slab to a cross sectional dimension less than 9 $mm^2$ per one grain.

In this connection, it is desirable that the ratio in thickness of the equi-axed crystal zone to the total thickness of the slab is at least 20%, although it varies depending on the casting conditions.

When most of the grains in the equi-axed crystal zone are reduced in their size as defined above according to the present invention, a uniform grain size can be achieved, and some degree of non-uniformity in the grain size has no adverse effect on the desired results of the present invention so far as it is within the range defined in the present invention.

According to the present invention, it is possible to restrict the diameter of the grains developing from the equi-axed crystal zone to about 5 to 60 mm during the slab heating to a temperature between 1300° and 1400° C, and to eliminate the occurrence of the incomplete recrystallization portion in the final product, and thus it is possible to obtain excellent magnetic properties of the final product.

The cast structure of the slab obtained by the present invention, and the change in the macro-structure of the same slab after the heating at 1360° C are illustrated respectively in FIG. 4(a) and (b).

As stated hereinbefore, the object of this invention is to provide a grain-oriented electrical steel sheet having excellent magnetic properties from a continuously cast steel slab, and more particularly to provide a grain-oriented electrical steel sheet having a magnetic flux density ($B_{10}$) not less than 1.83 T (tesla). The present invention is most advantageous for production of a grain-oriented electrical steel sheet having a high magnetic flux density ($B_{10}$) between 1.89 and 1.96T.

Figure 5:
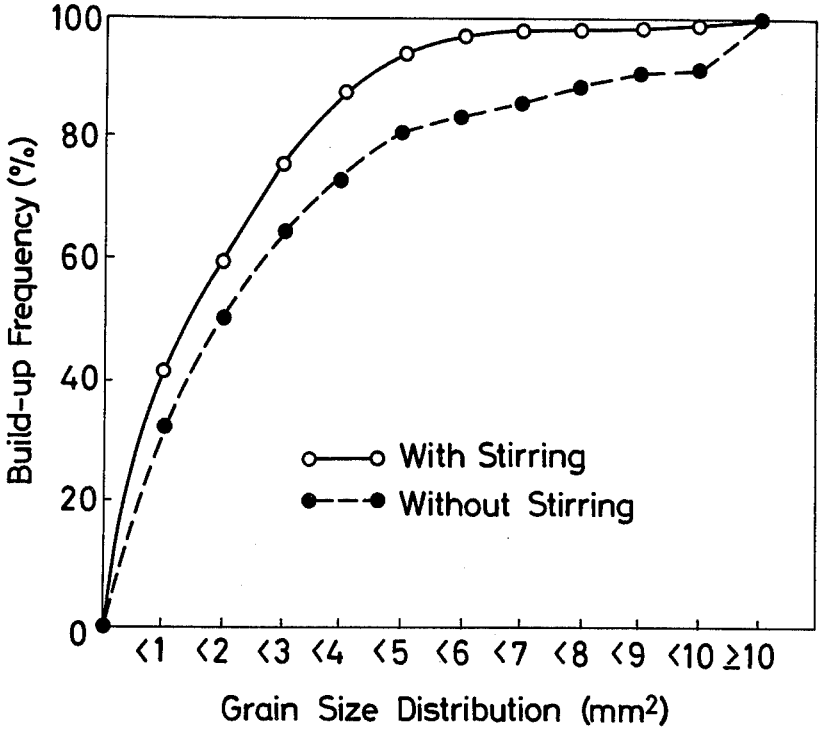
FIG. 5 is a graph showing a typical pattern of the grain size distribution in the equi-axed crystal zone of the slab central portion.

A typical cross sectional size distribution pattern of the grains constituting the equi-axed crystal zone in the slab central portion is shown in FIG. 5. Generally, the slab central portion is composed of equi-axed grains ranging from the smallest grain of about 0.03 $mm^2$ to the largest grain of about 30 $mm^2$ and the mean value of the grain size distribution ranges from about 0.5 $mm^2$ to about 3 $mm^2$.

In a slab continuously cast according to the conventional methods, the grain size of the equi-axed crystals in the slab central portion is not uniform, and large grains of 9 $mm^2$ or larger are present, more than about 10%. Therefore, when heated to high temperatures, some of these large grains are considered to grow into coarser grains.

On the other hand, in the continuously cast slab according to the present invention, the grain size of the equi-axed grains in the slab central portion is relatively uniform, and large grains larger than 9 $mm^2$ are not present substantially. Therefore, in the continuously cast slab according to the present invention, it is considered to be difficult for any specific large grain to grow into a still coarser grain whenever heated to high temperatures.

Although it is very difficult to express the grain size distribution as shown in FIG. 5 in a simple term, it has been found from various investigations that no incomplete secondary recrystallized portion appears in the final product and a high level of magnetic properties can be obtained when the large grains of 9 $mm^2$ or larger are restricted in an amount of only 5% or less in the equi-axed crystal zone of the slab central portion.

Figure 6:
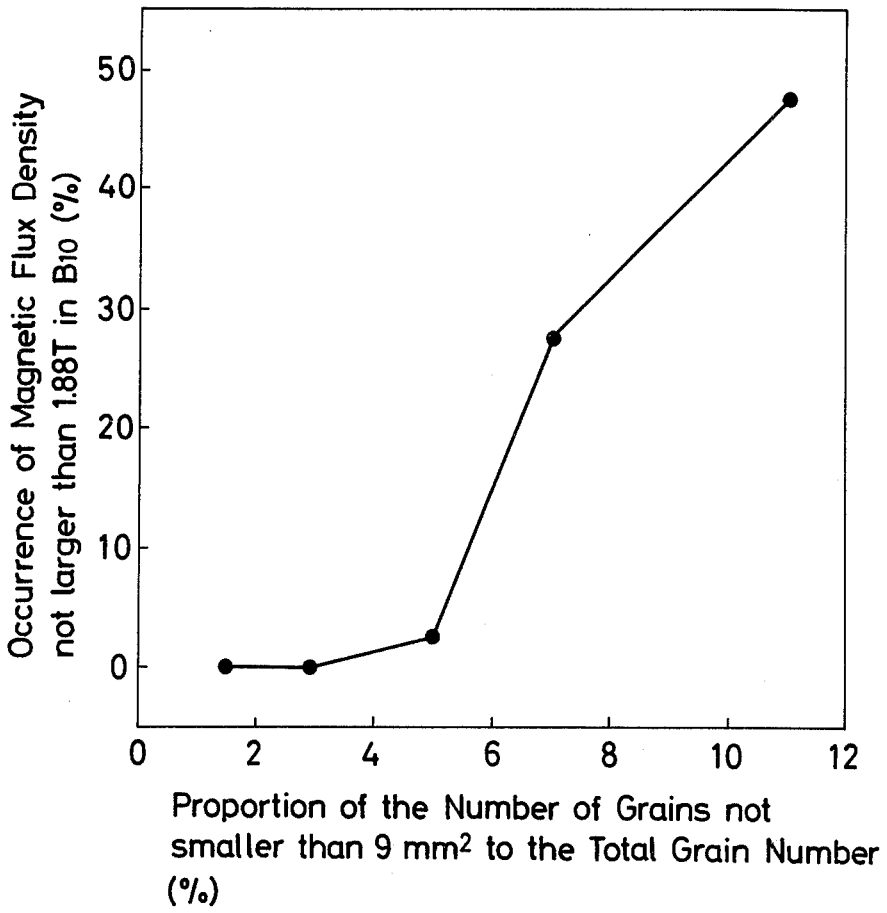
FIG. 6 is a graph showing the relation between the magnetic properties of the final product and the proportion in number of the grains of 9 $mm^2$ or larger in the equi-axed crystal zone of a continuously cast slab.

FIG. 6 shows the relation between the proportion of the grains of 9 $mm^2$ or larger and the magnetic properties and illustrates the above.

The steel composition used in the present invention may comprise 0.025 to 0.085% C, 2.5 to 3.5% Si, and an appropriate amount of two or more elements which form precipitated dispersions, with the balance being iron and unavoidable impurities.

The carbon content is limited to the range of from 0.025 to 0.085% because carbon contents lower than the range increase the amount of oxide inclusions in the steel and cause deterioration of the iron loss property with an unstable magnetic flux density, and on the other hand, carbon contents beyond the range elongate the annealing time during the decarburization annealing step, thus lowering the productivity on a commercial scale.

The silicon content is limited to the range of from 2.5 to 3.5% because with silicon contents lower than the range a single phase of ferrite can not be obtained during the high-temperature annealing, and on the other hand, with a silicon content beyond the range the steel fractures during the cold rolling.

The precipitated dispersion is essential for effecting the secondary recrystallization during the high temperature annealing and hence for increasing the intensity of (110)[001] in the final product.

As the precipitated dispersion, MnS or AlN alone or in combination is commonly utilized, but further any type of precipitated dispersion, such as MnSe and VN may be utilized in the present invention.

When AlN or MnS alone or in combination are utilized as the precipitated dispersion, the contents of the elements are usually within the following ranges: Al: 0.010 to 0.080%, N : 0.004 to 0.012%, Mn : 0.04 to 0.20%, S : 0.012 to 0.060%.

In addition, solute elements, such as Cu, Ni, Cr, Mo and P are often added intentionally to a grain-oriented electrical steel sheet, and in such cases also the desired results of the present invention can be achieved.

The molten steel to be continuously cast according to the present invention may be prepared by any conventional method, such as in a converter, an electric furnace and an open hearth. The thickness of the slab obtained by the continuous casting ranges usually from 120 to 300 mm.

It belongs to the known art to stir electromagnetically the molten steel to improve the cast structure of the slab, and various means for the electromagnetical stirring have been proposed. The present invention should not be limited to any specific method in respect with the electromagnetic stirring.

It is also known to stir electromagnetically the unsolidified molten steel during the continuous casting to promote the formation of an equi-axed grains in the electromagnetically stirred portion of the continuously cast slab. The present inventors have discovered that the electromagnetic stirring results in a uniform and fine grain size in the equi-axed crystal zone, and in the present invention this phenomenon is intentionally utilized for improving the magnetic properties.

Regarding the clarification of the mechanism of the formation of equi-axed grains in the cast slab structure, various hypotheses have been advocated, but as yet there has not been established a theory therefor. However, it has been revealed through various experiments that the formation of equi-axed crystals takes place only when the molten steel is stirred at a temperature not higher than the liquidus line.

Thus when a stirring device is positioned near the meniscus of a continuous casting machine where the average temperature of the unsolidified molten steel in the slab is above the liquidus line, it is difficult to achieve the formation of equi-axed crystals, and the equi-axed grains thus formed have non-uniform and large grain sizes, thus impossible to obtain the desired slab structure of the present invention. In the above case, it is necessary to maintain the temperature of the molten steel on the tundish as low as possible but which causes not only various operational problems in the continuous casting step, and also defects such as increased inclusions in the slab and deterioration of the magnetic properties of the final product.

The average temperature of the unsolidified molten steel in the continuously cast slab at a certain distance from the meniscus depends on the slab thickness, the casting speed, and the casting temperature, and gets lower as the slab thickness decreases as the casting speed is lower or as the casting temperature is lower.

It is not always true that the formation of equi-axed grains is achieved when the electromagnetic stirring is given to the molten steel at a temperature not higher than the liquidus line, but for the formation of a certain stirring force corresponding to the super heat of the molten steel (difference between the molten steel temperature and the liquidus temperature) is essential. Thus as the super heat increases the stirring force required for the formation of equi-axed grains is smaller.

Therefore, it is necessary to determine the position of the electromagnetic stirring device and the stirring force in correspondence to the slab casting conditions as described above.

Generally the columnar zone decreases and the equi-axed crystal zone increases in the electromagnetic stirred slab. When the continuous cast slab having the cast structure with electromagnetic stirring during the casting is heated in such a manner that the slab central portion is heated to a temperature of 1200° C or higher, no coarse grains develop locally. Therefore, the cast slab having the above structure does not produce any portion of the incomplete secondary recrystallization and contributes to enhance remarkably the magnetic properties of the final products.

There is no specific limitation regarding the slab temperature when the continuously cast slab is charged into a heating furnace prior to the hot rolling, so that the slab may be charged into the heating furnace immediately after the continuous casting.

If the slab heating temperature before the hot rolling is excessively low, the precipitated dispersion does not dissolve in solid solution, and on the other hand when the temperature is too high, the equipments on commercial scale can not be stood against the severe operational conditions. Therefore, the slab heating temperature is limited to the range of from 1300° to 1400° C.

According to the present invention, the continuously cast slab is hot rolled into a hot rolled steel sheet having about 1.5 to 5.0 mm thickness by a single step, and the hot band thus obtained is, if necessary, annealed at a temperature in a range of from 650° to 1200° C, and then cold rolled into a final thickness by an ordinary one-step cold rolling method or by a two-step cold rolling method involving an intermediate annealing. The cold rolled product thus obtained is subjected to decarburization annealing and further to secondary recrystallization annealing within a temperature range of from 950° to 1250° C.

EXAMPLE 1

A molten steel containing 0.06% C, 3.0% Si, 0.09% Mn, 0.03% Al was cast at 1555° C into a mold of 200 mm in thickness. An electromagnetic stirring device was provided at a position 2.4 mm apart from the meniscus, and two grades of continuously cast slabs were produced; one with the electromagnetic stirring and the other without the electromagnetic stirring. The distributions of the grain size in the central equi-axed crystal zone in the two grades of slabs are shown in FIG. 5, and the number of grains not larger than 9 $mm^2$ was 98% of the total grain number in the equi-axed zone in case of the slab with the electromagnetic stirring, while the number in case of the slab without the electromagnetic stirring was 91%. The above two grades of slabs were heated to 1360° C, and hot rolled into hot rolled steel sheets of 2.3 mm in thickness, which were then annealed at 1100° C, cold rolled into a final thickness of 0.30 mm, and subjected to decarburization annealing at 850° C and further to secondary recrystallization annealing at 1200° C. The magnetic properties in the rolling direction of the final products thus obtained were as below.

Final product from the slab with electromagnetic stirring:

$B_{10} = 1.93$ T $W_{17/50} = 1.10$ W/kg

Final product from the slab without electromagnetic stirring:

$B_{10} = 1.77$ T $W_{17/50} = 1.68$ W/kg

It is clear from the above results that the final product from the slab according to the present invention shows better magnetic properties.

EXAMPLE 2

A molten steel containing 0.04% C, 2.8% Si, 0.08% Mn, 0.03% Al was continuously cast at 1540° C into a mold of 200 mm in thickness. An electromagnetic stirring device was provided at a position 2.4 mm apart from the meniscus, and two grades of continuously cast slabs were produced; one with the electromagnetic stirring and the other without the electromagnetic stirring. The distribution of grain size in the central equi-axed crystal zone of the two grades of slabs was that the number of grains not larger than 9 $mm^2$ was 99% of the total grain number in the equi-axed zone in case of the slab with the electromagnetic stirring, while the number in the slab without the electromagnetic stirring was 93%.

The above two grades of slabs were heated to 1340° C and hot rolled into hot rolled steel sheets of 2.5 mm in thickness, which were then annealed at 1050° C, cold rolled into a final thickness of 0.35 mm, and subjected to decarburization annealing at 840° C and further to secondary recrystallization annealing at 1200° C. The magnetic properties in the rolling direction of the final products thus obtained were as below.

Final product from the slab with electromagnetic stirring:

$B_{10} = 1.92$ T $W_{17/50} = 1.20$ W/kg

Final product from the slab without electromagnetic stirring:

$B_{10} = 1.81$ T $W_{17/50} = 1.50$ W/kg

It is clear from the above results that the final produce from the slab according to the present invention shows better magnetic properties.

FIGS. 1 to 4 show respectively a typical cross sectional macro-structure of a continuously cast slab for grain oriented electrical steel sheets.

It is clearly shown in FIG. 1 that the columnar grains develop, with a smaller number of equi-axed grains and with non-uniform grain size being present in the central portion in the ordinary continuously cast slab without the electromagnetic stirring.

FIG. 2 and FIG. 3 are respectively a cross sectional structure of an ordinary continuously cast slab without electromagnetic stirring, in which steps of developments of coarse grains from the central equi-axed crystal zone are shown. Particularly in FIG. 2, it is clearly shown that the coarse grains develop from the central equi-axed zone which is the lowest temperature zone before the complete grain growth in the columnar crystal zone.

Figure 4:
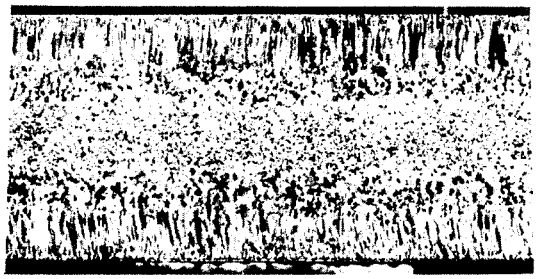
FIG. 4(a) is a photograph showing a cross sectional structure of a continuously cast slab according to the present invention.
FIG. 4(b) is a photograph showing the changes of the macro-structure after the heating of the continuously cast slab shown in FIG. 4(a).
Figure 4:
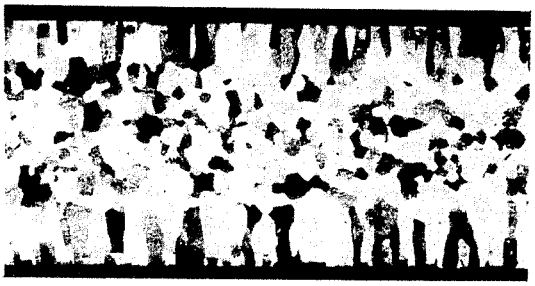

FIGS. 4(a) and (b) show cross sectional structures of continuously cast slabs with electromagnetic stirring, heated under the conditions illustrated in Example 1 prior to the hot rolling. Particularly in FIG. 4 it is clearly shown that the grains in the central equi-axed crystal zone are fine and uniform in size, and the grains developing from the equi-axed crystal zone after the slab heating at 1360° C are finely divided.

FIG. 5 shows how the grain size distribution in the central equi-axed crystal zone is improved by giving electromagnetic stirring to the molten steel during the continuous casting in case of Example 1.

The control of grain size during the production process of grain-oriented electrical steel sheet is already disclosed in U.S. Pat. No. 2,867,558, U.S. Pat. No. 2,867,559, Japanese Patent Publication No. Sho 50-37009 and U.S. Pat. No. 3,841,924 and U.S. Pat. No. 3,764,406. However, the first two prior arts specify the grain size after the intermediate heat treatment during the two-step cold rolling, and the last two prior arts specify the grain size after the intermediate heat treatment during the two-step hot rolling of a continuously cast slab. Therefore, these prior arts are completely different from the present invention.

In short, the above four prior arts specify the grain size after the heat treatment following the working strain application, whereas in the present invention, the cast structure of the slab is improved so that the grain size in the slab central portion after the heat treatment without application of working strain to the slab is improved. In this point, the present invention is a completely new technique.

What is claimed is:

1. A continuously cast steel slab for production of a grain-oriented electrical steel sheet having excellent magnetic properties in which at least 95% of the total number of grains constituting an equi-axed crystal zone in said slab has a cross sectional dimension less than 9 $mm^2$ per one grain.

2. The continuously cast slab according to claim 1, in which said slab is electromagnetically stirred during its solidification in the continuous casting step.

3. The continuously cast slab according to claim 1, in which said slab is heated to a temperature between 1300° and 1400° C and is hot rolled to a hot band without reheating.

* * * * *